US011060814B2

(12) United States Patent
Ellis

(10) Patent No.: US 11,060,814 B2
(45) Date of Patent: Jul. 13, 2021

(54) CROSSBOW COCKING USING TWO SEPARATE HANDHELD PULLERS

(71) Applicant: Daryl Ellis, Winnipeg (CA)

(72) Inventor: Daryl Ellis, Winnipeg (CA)

( * ) Notice: Subject to any disclaimer, the term of this patent is extended or adjusted under 35 U.S.C. 154(b) by 0 days.

(21) Appl. No.: 16/859,335

(22) Filed: Apr. 27, 2020

(65) Prior Publication Data

US 2020/0370860 A1 Nov. 26, 2020

Related U.S. Application Data

(60) Provisional application No. 62/852,522, filed on May 24, 2019.

(51) Int. Cl.
*F41B 5/12* (2006.01)
*F41B 5/14* (2006.01)

(52) U.S. Cl.
CPC ..... *F41B 5/1469* (2013.01); *F41B 5/12* (2013.01); *F41B 5/123* (2013.01)

(58) Field of Classification Search
CPC ..... F41B 5/12; B65G 7/12
See application file for complete search history.

(56) References Cited

U.S. PATENT DOCUMENTS 161,678 A * 4/1875 Gardner ..... F41B 5/12 124/86
555,681 A * 3/1896 Dalton ..... G06Q 10/10
2,482,314 A * 9/1949 Beckwell ..... A01K 97/14 294/26
2,610,884 A * 9/1952 Herman ..... A47G 21/00 294/15
3,125,907 A * 3/1964 Derrickson ..... B65B 13/025 81/488
5,243,956 A * 9/1993 Luehring ..... F41B 5/12 124/86
7,624,125 B2 * 11/2009 Feinsmith ..... G06Q 10/10
8,439,024 B2 * 5/2013 Barnett ..... F41B 5/1469 124/25
8,573,192 B2 * 11/2013 Bednar ..... F41B 5/12 124/86
9,285,182 B2 * 3/2016 Bednar ..... F41B 5/1469
10,041,756 B2 * 8/2018 Bednar ..... F41B 5/12
10,126,092 B2 * 11/2018 Ozanne ..... F41B 5/123
2012/0037139 A1 * 2/2012 Barnett ..... F41B 5/1469 124/86

* cited by examiner

*Primary Examiner* — John A Ricci
(74) *Attorney, Agent, or Firm* — Kyle R Satterthwaite; Michael R Williams; Ade & Company Inc.

(57) ABSTRACT

A crossbow cocking apparatus comprises a pair of completely separate, unconnected, handheld string pullers, each comprising a hand grip holdable in a closed-fisted manner in a respective hand of a user, and a rigid hooking arm reaching outwardly therefrom and carrying a hook feature thereon at a fixed position relative to the hand grip for hooked engagement with the bow string. While holding a respective one of the string pullers in each hand, a user hooks the bow string with the two string pullers on opposite sides of a stock of the crossbow, and draws the bow string rearwardly along the stock into engagement with a latch of the crossbow.

9 Claims, 4 Drawing Sheets

CROSSBOW COCKING USING TWO SEPARATE HANDHELD PULLERS

CROSS REFERENCE TO RELATED APPLICATIONS

This application claims benefit under 35 USC 119(e) of U.S. Provisional Patent Application No. 62/852,522, filed May 24, 2019, the entirety of which is incorporated herein by reference.

FIELD OF THE INVENTION

The present invention relates generally to crossbows, and more particularly to techniques and apparatuses helpful in the cocking of a crossbow.

BACKGROUND

Unaided manual cocking of a crossbow is a strenuous exercise requiring notable strength to pull back the bow string into engagement with the latch of the crossbow using only a direct manual grip of the bow string in the user's bare hands on both sides of the stock. Cocking device made available to ease this process include rope cockers and crank cockers.

A rope cocker features a length of rope having two T-shaped hand grips attached at its opposing ends, and a pair of pulley-carried hooks installed on the rope between the two hand grips. A mid-point of the rope is routed across the stock at suitable brace point, for example at a dedicated slot provided for this purpose at a rear end of a sight bridge situated behind the latch. From here, the two ends of the rope are drawn forwardly along the stock on opposite sides thereof toward the bow string to enable engagement of the pulley-carried hooks to the bow string at discrete points on said opposite sides of the stock. The hand grips are then held and pulled rearwardly along the stock, which acts to pull the bow string rearwardly into engagement with the latch via the two hooks. A crank cocker does away with the hand grips, and instead employs a crank mechanism mounted to the stock for drawing the bow string via the pulley-carried hooks.

While these mechanisms successfully operate to their intended purpose of reducing the physical exertion required to cock the crossbow, a crank cocker can carry notable cost and requires modification of the crossbow stock to mount the crank mechanism, and both require some kind of reset each time the apparatus is used (routing of the rope across the brace point, or unwinding of the crank). Accordingly, there remains a need for other alternatives that ease the cocking process relative to unaided manual cocking, but avoid the shortcomings of commercially available rope and crank cockers.

SUMMARY OF THE INVENTION

According to one aspect of the invention, there is provided a crossbow cocking apparatus for aided pulling of a bow string of a crossbow into a cocked position for loading, said apparatus comprising a pair of completely separate, unconnected, handheld string pullers; each comprising a hand grip holdable in a closed-fisted manner in a respective hand of a user, and a rigid hooking arm reaching outwardly from said hand grip and carrying a hook feature thereon at a fixed position relative to the hand grip for hooked engagement of said hooking feature with the bow string.

According to another aspect of the invention, there is provided a method of using the forgoing apparatus, said method comprising, while holding a respective one of the string pullers in each hand, hooking the bow string of the crossbow with the hooking features of the string pullers on opposite sides of a stock of the crossbow, and drawing the bow string rearwardly along the stock into engagement with a latch of the crossbow.

BRIEF DESCRIPTION OF THE DRAWINGS

One embodiment of the invention will now be described in conjunction with the accompanying drawings in which.

DETAILED DESCRIPTION

Figure 1:
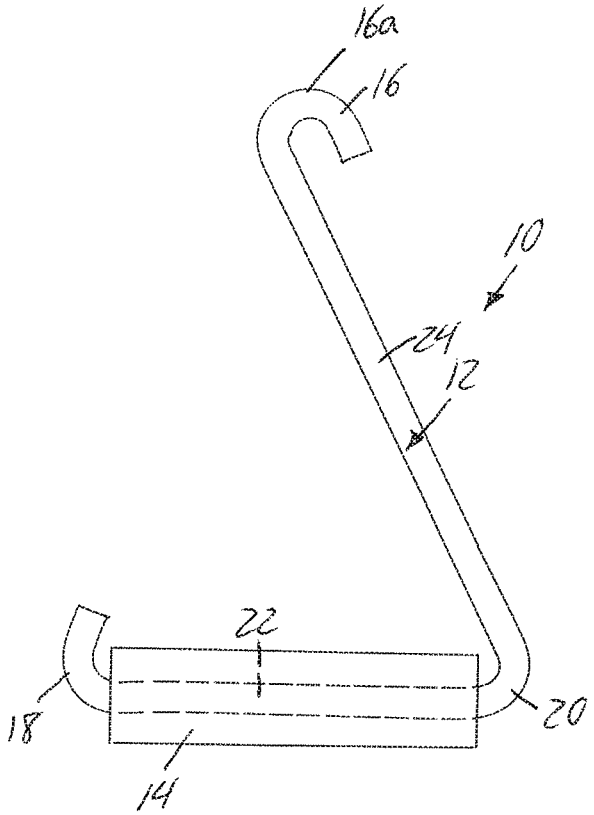
FIG. 1 shows a singular one of two matching handheld string pullers cooperatively used as a crossbow cocking apparatus according to the present invention.
Figure 2:
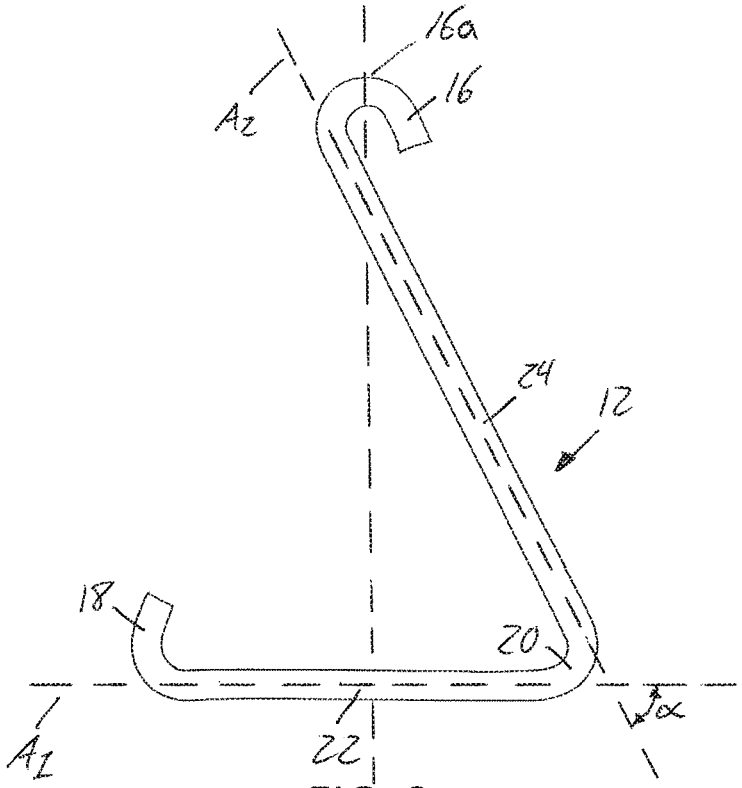
FIG. 2 shows the handheld string puller of FIG. 1 with a grip sleeve thereof removed to show an entirety of bent metal rod that forms a main structural body of the string puller.

FIG. 1 shows one of two matching handheld string pullers cooperatively used as a novel crossbow cocking apparatus of the present invention. Each string puller 10 features a main structural body 12 formed of a length of circular-section metal rod bent into a functional shape described below, and a grip sleeve 14 disposed circumferentially around one portion of the rod to cooperative define therewith a comfortable hand grip for manual gripping of the puller in a respective hand of the user. The metal rod of the main body 12 is bent through approximately 180-degrees at one of its terminal ends, which is therefore referred to herein as a hooked end 16 of the main body. The opposing terminal end of the metal rod is also bent, though not necessarily through a full 180-degrees, for example being bent at approximately 110-degrees in the illustrated example. This bend is for the purpose of retaining the grip sleeve 14 on the metal rod, and so this bend and the terminal end at which it resides are referred to as a retention bend or bent retention end 18. A third and final bend in the metal rod resides an at intermediate point between the two bent terminal ends, and is referred to herein as a transitional bend 20, as it serves the purpose of joining together two elongated segments 22, 24 of the rod that each span between the transitional bend 20 and a respective one of either the hooked end 16 or bent retention end 18 of the metal rod.

The first elongated segment 22 spans linearly along a first axis $A_1$ between the bent terminal end 18 and the transitional bend 20. The second elongated segment 24 spans linearly along a second axis $A_2$ between the transitional bend 20 and the hooked terminal end 16. The second axis $A_2$ obliquely intersects the first axis $A_1$ at an acute angle $\alpha$, which in the non-limiting illustrating example measures approximately 60-65 degrees. The hooked end 16 of the metal rod curves outwardly from the second elongated segment 24 on a side thereof opposite that to which the first linear segment 22 extends. An apex 16*a* of the hooked end 16 furthest from the from the first axis $A_1$ lies on a third reference axis $A_3$, which perpendicularly bisects the first linear segment 22 at a midpoint thereof. Accordingly, the hooked end 16 of the second elongated end resides generally midway between the transitional bend 20 and bent terminal end 18 of the first elongated segment 22.

The grip sleeve 14, which optionally may be made of foam, plastic, rubber, neoprene or other resiliently flexible and compressible material, is disposed circumferentially around the first elongated segment 22 of the metal rod, and is axially captured between the retention bend 18 and the transitional bend 20. These two bends thus prevent the sleeve 14 from sliding off the first elongated segment 22 in either axial direction thereof. Instead of a relatively compressible material whose outer surface is resiliently depressed when squeezed in the hand of a user, the grip sleeve may alternatively be a molded grip of relatively rigid plastic that doesn't undergo such resilient compression under the manually squeezing forces experienced during use of the invention. The grip sleeve may also have a series of finger grooves molded therein to better conform with a user's grip and provide notable comfort, despite a lack of relative compressibility in such instances. Where a compressible material is employed, the sleeve may be a slotted sleeve having an axial slot that forms a circumferential gap therein by which the sleeve can be removably engaged onto, and disengaged from, the respective elongated segment 22 of the wire rod, for example to enable replacement or substitution of different grip sleeves. Alternatively, the sleeve may have a more permanent attachment, and thus close fully around the respective elongated segment 22 in a non-removable manner, for example being molded onto the wire rod during manufacture using known insert molding techniques. In such instances, the inclusion of a bent retention end 18 may optionally be omitted if the grip sleeve 14 is securely retained on the wire rod as a result of the insert molding, or another affixation process optionally employed during manufacture.

The thickness of metal rod and the associated bending strength thereof is selected to maintain a fixed, rigid shape of the metal rod during the anticipated range of forces experienced thereby during use of the present invention. Accordingly, the main structural body 12 maintains a fixed, rigid shape after bending of the rod into this shape during the manufacture of the puller. The second elongated segment 24 of the metal rod thus defines a rigid hook arm of fixed length and fixed angle measured from the first axis $A_1$ of the hand grip that is held in a user's hand in closed-fisted manner during use of the present invention. Therefore, the hooked end 16 of the metal rod defines a hooking feature of fixed, static position relative to the hand grip, unlike the prior art where the pulley-carried hooks are linked to one or more hand-gripped elements (hand crank of a crank cocker, or hand grips of a rope cocker) by flexible ropes, cords or cables that allow relative movement between the hooks and the hand-gripped element(s), as required for the operation of the prior art cockers. The present invention thus omits the flexible ropes, cords or cables of the prior art, as well as the associated pulleys that allow the hooks to move along the ropes, cords or cables relative to the user's hands in the prior art cockers. The two string pullers of the present invention are therefore entirely separate, discrete, unconnected entities lacking any type of connection between them.

Figure 3:
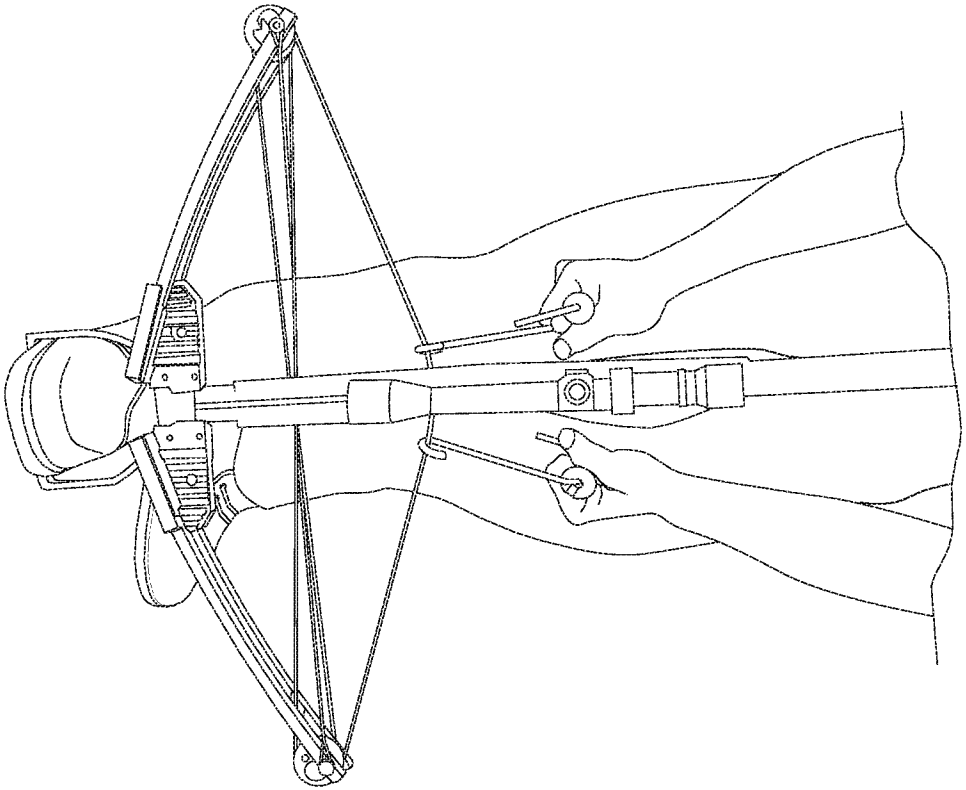
FIG. 3 shows a first step of crossbow cocking process, in which the pair of handheld string pullers are hooked to the bow string.

Having described the structure shared by each of the two handheld string pullers, attention is now turned to their use in the cocking of the crossbow. Referring to FIG. 3, in a conventional manner, the cross-bow is first stood in an upright position on a floor or ground surface, and is held in this upright position by receipt of a user's foot in the foot stirrup at the front end of the crossbow stock. Each of the two string pullers is held in a respective hand of the user in a closed-fisted fashion with the fingers of that hand wrapped around the hand grip, and in an orientation such that the transitional bend 20 reaches out from the closed fist at the thumb-end thereof, and the hook arm 24 spans outward from the closed fist in a forward direction away from the wrist (as opposed to a rearward direction toward the wrist, or a lateral direction outward from the knuckle or palm side of the fist). With the user's one foot maintained in the stirrup for holding thereof against the ground to maintain the ground or floor seated upright position of the crossbow, the user hunches forwardly over the upright stock of the cross-bow, reaches downwardly with the two handheld string pullers 10 on opposite sides of the stock, and engages the hooked ends 16 of the string pullers 10 with the bow string at respective hooking points near the stock on the two opposing sides thereof, as shown in FIG. 3.

Figure 4:
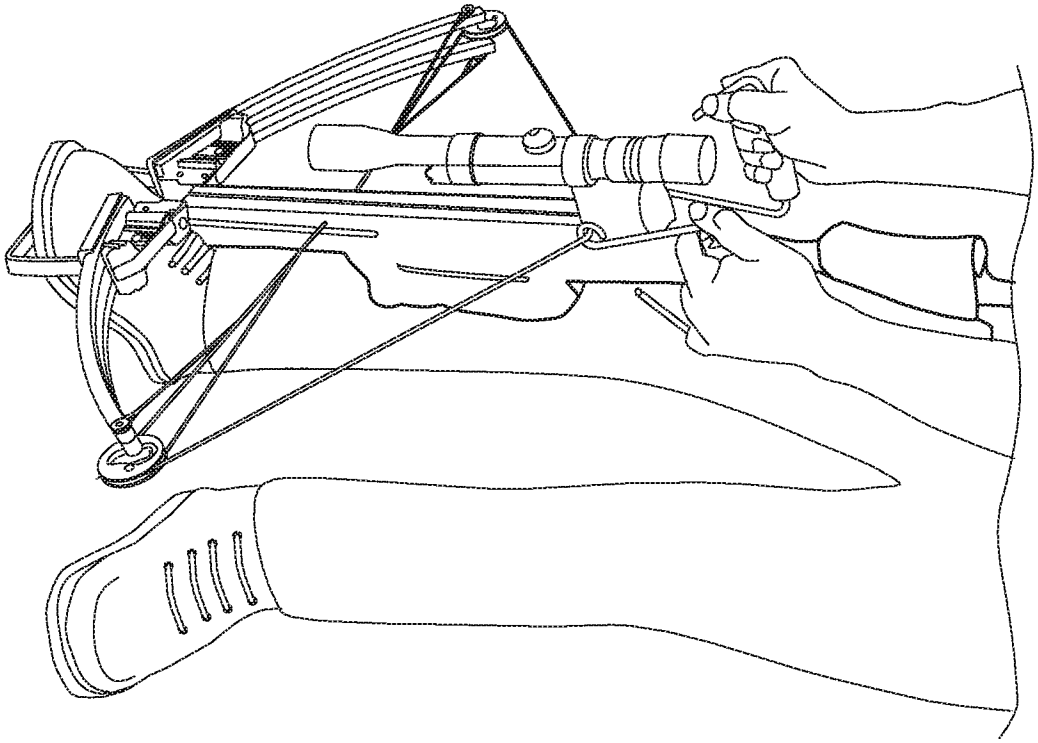
FIG. 4 shows a second step of the cocking process, in which the pair of handheld string pullers are pulled rearwardly along the stock to latch the bow string in a cocked position.

As shown in FIG. 4, the user pulls the two string pullers upwardly away from the floor or ground, thus pulling the midpoint of the bow string upwardly (i.e. rearwardly along the stock, away from the front bow-end thereof toward the rear butt-end thereof), into engagement with the latch of the crossbow. Unlike the pulley-equipped prior art cocking devices described above, the pulley-free apparatus of the present invention doesn't reduce the draw force that must be physically exerted by the user. However, by employing handgrip-mounted hooks to engage the bow string rather than the bare fingers of the user, the apparatus avoids uncomfortable digging of the tensioned bow string into the skin of the user's hand, thus eliminating or decreasing the discomfort experienced during the physical exertion of the full draw force. Provided that the user has the physical strength to exert a sufficient draw force, the apparatus of the present invention allows them to perform repeated cocking and loading of the crossbar with greater ease and comfort without the physical hand stress associated with unaided manual cocking. Also, the hand position using the present invention is rotated 90-degrees from the hand position of unaided manual cocking, as the knuckles lie perpendicular to the bow string, rather than parallel thereto, which may alter the particular muscle group being used to draw the bow string, to the potential benefit of the user.

Figure 5:
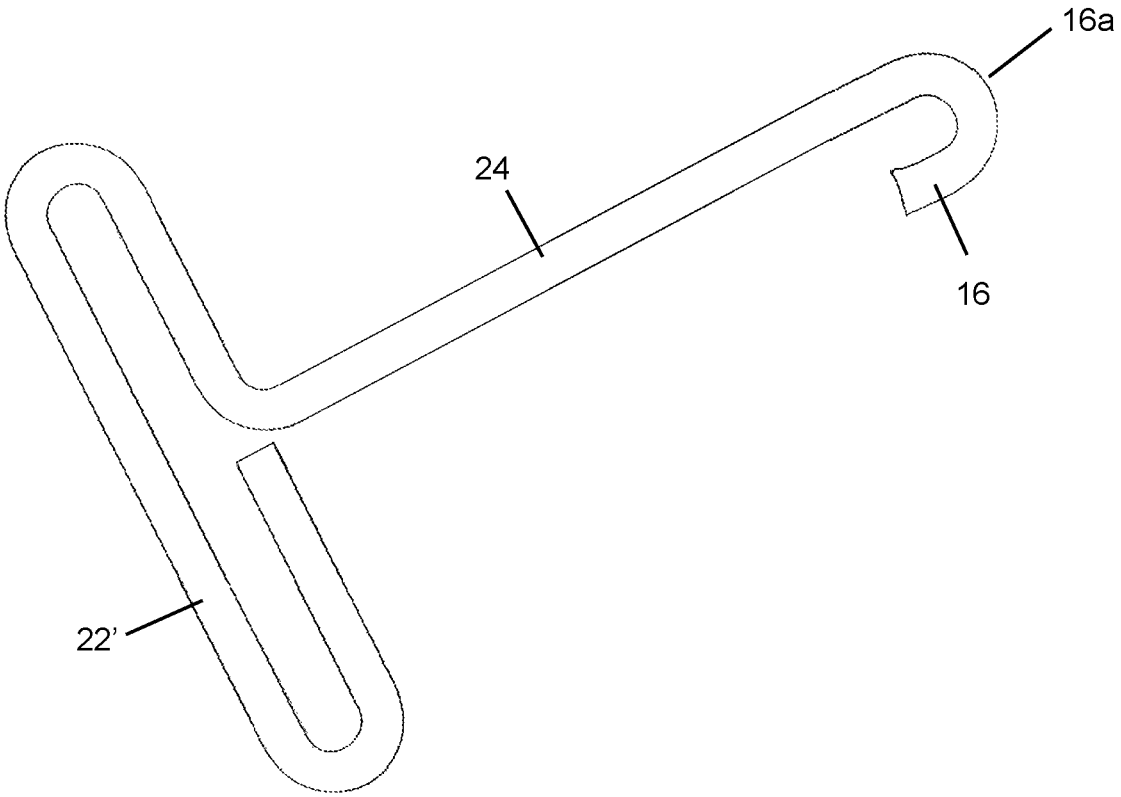
FIG. 5 illustrates a variant of the main structural body of FIG. 2.

While the illustrated embodiment employs a singular rod as the main body of the string puller, to which an additional outer grip is preferably, though optionally, added, for example in the form of a compressible grip sleeve, other embodiments may deviate from this particular structure, while still having the similar result of a hand grip to be held in a closed-fisted hand of the user, and a hook arm extending a distance outwardly from the hand grip to reach forwardly from the user's fist and carry a hooked feature at a rigidly fixed distance outward therefrom to engage the bow string. In the illustrated embodiment, the acutely angled relationship between the hook arm and the hand grip places the hooked end 16 in generally aligned relation to the midpoint of the hand grip, so the hooking point at which the bow string is pulled aligns generally with the midpoint of the user's fist. In an alternative embodiment, the acute angle may be replaced with a right-angle relationship between the hand grip and hook arm. In one example, this may take the form of an L-shaped string puller, with the hook arm once again spanning from one end of the hand grip, in which case a singular bent-rod with only a single transitional bend between its two ends may once again be employed, though the hooking point would be offset to the thumb-side of the user's fist, rather than centered midway across the fist. In another example, a T-shaped string puller may be used, with the hook arm radiating outward from the hand grip at an intermediate or mid point thereof to reach out from between two adjacent fingers of the user's fist, though such T-shaped embodiments may require a multi-piece body construction, or a greater number of transitional bends in a single-rod construction, for example as demonstrated by the variant in FIG. 5, where the rod is doubled up at the hand grip 22' to enable a seam lessy integral hook arm to extend centrally and perpendicularly from the hand grip in a unitary metal rod construction of the main structural body.

It will also be appreciated a metal rod body construction need not necessarily be employed, and in a non-limiting alternative example, an overall comparable shape and structure may be formed by through molding of a sufficiently rigid plastic structural body, to which a resiliently plastic outer grip may optionally be added at the hand grip. Where a wire rod body is employed as a skeletal core to which a moulded-on outer grip is added, it will also be appreciated that the wire rod body need not necessarily span the full axial length of the hand grip, as it does in the illustrated example, as the wire rod may alternatively terminate somewhere within the outer hand grip without reaching the distal end thereof furthest from the transitional bend.

Since various modifications can be made in my invention as herein above described, and many apparently widely different embodiments of same made, it is intended that all matter contained in the accompanying specification shall be interpreted as illustrative only and not in a limiting sense.

The invention claimed is:

1. A method of cocking a crossbow, said method comprising:

possessing a pair of completely separate, unconnected, handheld string pullers; each comprising a hand grip holdable in a closed-fisted manner in a respective hand of a user, and a rigid hooking arm reaching outwardly from said hand grip and carrying a hook feature thereon at a fixed position relative to the hand grip for hooked engagement of said hooking feature with the bow string; and while holding a respective one of the handheld string pullers in each hand, hooking the bow string of the crossbow with the hooking features of the string pullers on opposite sides of a stock of the crossbow, and drawing the bow string along the stock into engagement with a latch of the crossbow.

2. The method of claim 1 wherein each handheld string puller comprises a metal rod spanning from the hand grip to the hooking feature.

3. The method of claim 2 wherein said metal rod is a bent metal rod having a first elongated portion spanning at least a partial length of the hand grip, and a second elongated portion spanning from the hand grip to the hooking feature.

4. The method of claim 3 wherein the second elongated portion is angled obliquely to the first elongated portion.

5. The method of claim 2 wherein the hooking feature comprises a hooked end of the metal rod.

6. The method of claim 2 wherein the hand grip comprises an outer grip member disposed around the metal rod.

7. The method of claim 6 wherein the metal rod comprises a retention bend at an end of the first elongated portion opposite the transitional bend to block sliding of the outer grip member off the metal rod.

8. The method of claim 1 wherein the hooking arm is angled obliquely to the hand grip.

9. The method of claim 8 wherein the hooking arm is obliquely oriented at an acute angle to hand grip.

* * * * *